United States Patent [19]

Grossman

[11] 3,955,239

[45] May 11, 1976

[54] BATHTUB CLOSURE MEANS HAVING VERTICALLY SLIDABLE PANELS

[76] Inventor: Abraham Grossman, 9339 Rhea Ave., Northridge, Calif. 91324

[22] Filed: Oct. 10, 1974

[21] Appl. No.: 513,836

Related U.S. Application Data

[62] Division of Ser. No. 362,743, May 22, 1973, Pat. No. 3,860,975.

[52] U.S. Cl. ..... 16/96 R; 4/149; 49/452

[51] Int. Cl.[2] ..... A47H 1/04; A47H 15/00; E05D 13/02; E05D 15/06

[58] Field of Search ..... 16/96 R, 87 B; 49/445, 49/452, 453, 380, 454; 4/149, 153, 154

[56] References Cited

UNITED STATES PATENTS 2,948,028 8/1960 Cameron ..... 49/452 X

*Primary Examiner*—Werner H. Schroeder
*Assistant Examiner*—Wayne L. Shedd
*Attorney, Agent, or Firm*—Poms, Smith, Lande & Glenny

[57] ABSTRACT

A bathtub closure means comprising horizontally extending panel means arranged to close about two-thirds of the distance between the top of a tub wall and a ceiling of normal height and arranged in open position to provide access and entry to the tub along virtually the entire length of the tub with substantial head room. A bathtub closure and method of assembly comprising jamb means, sill means, panel means, and panel guide means arranged and constructed to facilitate shipping, installing, assemblying and aligning in an opening to provide an effective closure of light weight and smooth operation.

6 Claims, 21 Drawing Figures

XIII
XII
~26'~
~27'~
35'
33'
186
56'
77'
38'
86'
97'
100
103
187
92a
60'
157
98
104
87'
96'
88'
102
92'
59'
50'
25'
38'
36'

44'
56'
51'
53'
92a
54'
50'
25
92'
102b
36a
72'
74'
63'
60'
75'
73'
27'
88'
87'
158
59'
157
54'

44'
101
156
158
53'
86'
50'
56'
25'
162
36a
164
74'
63'
88'
161
26'
159
157
75'
163
160
158
59'
54'

BATHTUB CLOSURE MEANS HAVING VERTICALLY SLIDABLE PANELS

This is a divisional application of application Ser. No. 362,743 filed May 22, 1973, now U.S. Pat. No. 3,860,975.

BACKGROUND OF THE INVENTION

Bathtub-shower combinations are frequently installed in modern homes to provide combined facilities for either bathing in the bathtub or showering. Where such combination tub and shower is installed, some type of enclosure is provided for the tub to prevent leakage and splashing of water outside of the tub area during showering. In some bathtub installations an enclosure for the bathtub is desired for privacy.

Prior enclosures have included shower curtains which may be drawn to one or both ends of the bathtub to facilitate entry into the tub, hinged doors which open outwardly from a framed opening which may include one or more fixed panels extending upwardly from the bathtub wall; or horizontally slidable panels guided by top and bottom frame guides supported on the tub wall and at selected height above the tub wall.

In the latter two types of enclosures involving hinged or horizontally slidable doors or panels, access to the bathtub is restricted and limited. Therefore such enclosures hamper and increase the difficulty of cleaning such an enclosed bathtub. In addition, children are often bathed in bathtubs by mothers who must kneel or sit alongside the tub and attempt to properly bath the child by reaching through the fixed door opening. Obviously, such fixed closures for the bathtub present disadvantages in both cleaning the tub and in bathing a child therein. In addition, such prior enclosures usually included vertical joint lines, not only at the jambs but also at the vertical edges of a hinged door or vertical interlock edges of horizontal sliding panels. Such additional vertical joints to be sealed required careful assembly and installation with restricted tolerances in order to provide a leakproof enclosure.

SUMMARY OF INVENTION

The present invention relates to a novel bathtub closure means wherein the disadvantages of the prior fixed type of hinged or slidable door enclosures are avoided while retaining all of the advantages of such fixed sturdy and readily maintained closure constructions. The present invention relates particularly to a bathtub closure means utilizing horizontal panels extending for substantially the length of the bathtub and vertically slidably movable into a space at the top of the bathtub opening to provide adequate head room for entering the tub or for bathing a child.

An object of the invention is to disclose and provide a novel bathtub closure means providing virtually unrestricted access to a bathtub along the horizontal length of the bathtub in closure open position.

Another object of the invention is to disclose and provide a bathtub closure means wherein horizontal panels are arranged one above the other and in closed position provide an effective construction to prevent water leakage from the bathtub area.

Another object of the present invention is to disclose and provide a bathtub closure means so constructed and arranged that the horizontal panels are readily raised or lowered into desired open or closed position.

A further object of the present invention is to disclose and provide a novel bathtub closure means and method of installation utilizing rigid horizontal panel means which are readily assembled, easily operable, and readily adapted to both new and old building constructions.

Still another object of the present invention is to disclose and provide a novel bathtub closure means wherein jamb means adapted to be secured to walls at the ends of the tub are constructed and especially designed to provide an effective water tight construction for vertically slidable horizontal panels associated therewith.

A still further object of the present invention is to disclose and provide a bathtub closure means provided with jamb means as mentioned above wherein means are provided for selectively positioning the horizontal panel members and positive stop means are provided for the uppermost panel member to properly position the panel members in closed relation.

The present invention contemplates, in one embodiment thereof, a novel arrangement for connecting a slidable panel to a counterweight system in a jamb construction designed to minimize introduction of water into panel guide or track means provided in the jamb.

The invention contemplates, in one embodiment thereof, the provision of a multi-purpose panel supporting arm constructed to serve as a connection to a bumper member in one of the guide channels to facilitate assembly of vertically slidable panels with jamb means and then later to support said panels in counterweight finger positionable control of movement of the panels.

A further object of the invention is to design and provide a novel attachment member for supporting a panel and connecting the panel to a counterweight system operable in a jamb means.

The present invention contemplates a novel method of assemblying and installing a preferred embodiment of the bathtub closure means. Generally speaking, in such method of installation a sill member is installed in sealing relation to the top surface of the bathtub wall for its entire length. Jamb or track housings are then positioned at each end of the sill member and secured in sealing relation to the vertical walls at the end of the bathtub. Panel guide or track sections are laterally or telescopically slidably inserted into the track housings and carry pre-set panel hanger brackets at about the overlap zone of the upper and lower panels in closed position, the brackets being connected to the panel stop or bumper means carried in the track section by break off screw tabs. Corresponding sides of the upper and lower panels are then connected to the hanger brackets of the adjacent track section. The corresponding opposite sides of the upper and lower panels are then connected to the hanger brackets on the other track section. The laterally movable track sections with brackets and panels may now be centered in the space defined by the spaced track housings. The portions of the track sections adjacent the center of the panels are then secured by screws to the track housing. After the center portion of the track sections have been located in this manner, the screw holding each hanger bracket to the stop means is removed so that the panels are free to move vertically. The lower panel is brought into contact with the sill and the upper panel is raised to the ceiling. The lower and upper portions of the track sections are then adjusted so that they contact surfaces of the screw tabs of the hanger brackets and are then secured in the track housings by top and bottom screws. The hanger bracket portion providing a connection to the internal stop means is then removed by bending or breaking off along a line of reduced section. Proper clearance between the ends of the panel and the track sections is thereby provided. The method contemplated as described above is adapted to permit installation of the bathtub enclosure by one person.

Other objects and advantages will be readily apparent from the following description of the drawings in which an exemplary embodiment of this invention is shown.

IN THE DRAWINGS

Figure 2:
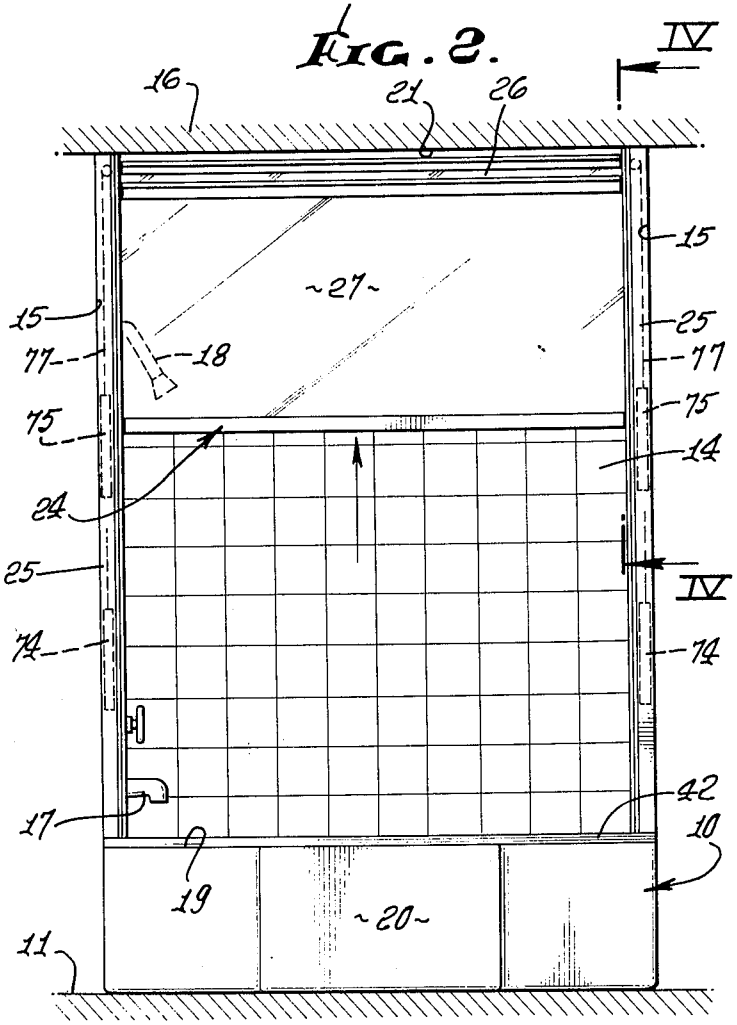
FIG. 2 is a front elevational view similar to FIG. 1 but showing the bathtub closure means in open position.
Figure 1:
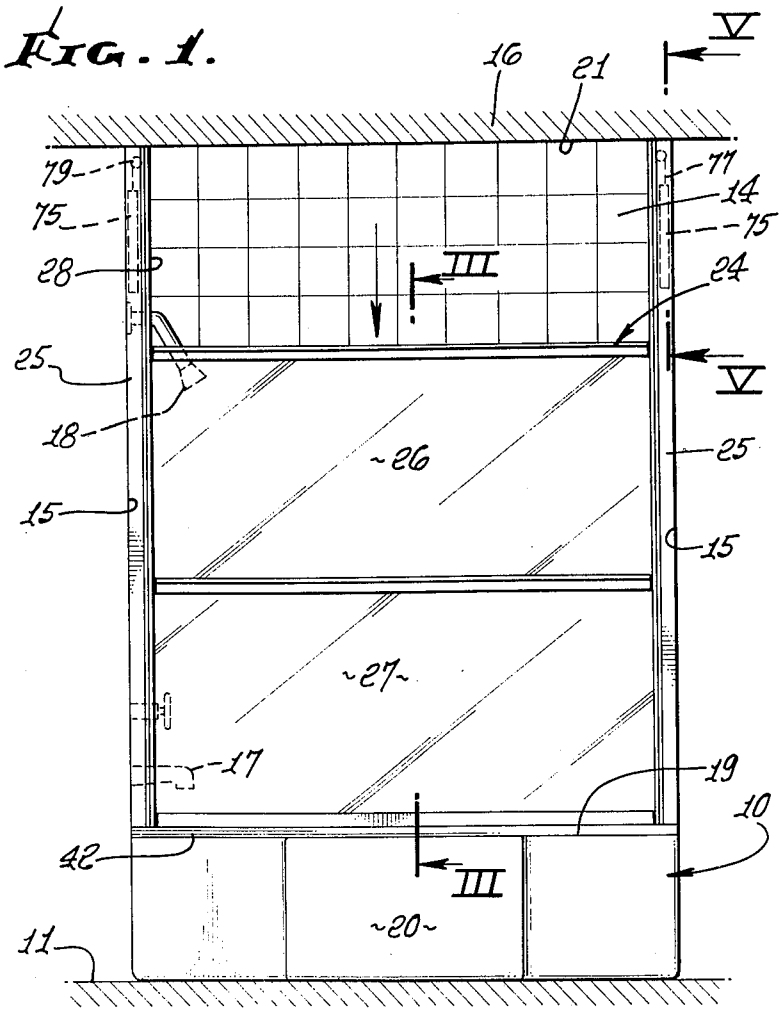
FIG. 1 is a front elevational view of a bathtub closure means embodying this invention installed in a framed opening for a bathtub, the bathtub closure means being shown in closed position.

In one example of this invention shown in the drawings, in FIGS. 1 and 2 a bathtub 10 is installed upon a floor surface 11 and in a suitable alcove or recess 12 having a back wall 14 of tile construction, end walls 15 and a ceiling 16. Projecting from one of the end walls 15 is a bathtub faucet 17 and a shower head 18. The end walls 15, ceiling 16 and the top edge 19 of the bathtub wall 20 define an opening 21 to be at least partially closed by bathtub closure means of this invention generally indicated at 24. It will be understood that the bathtub opening 21 may be defined by other framing construction as where the bathtub is not located in an alcove as illustrated but is located against only one or two walls of a bathroom.

Bathtub closure means 24 generally comprises jamb or housing means 25 which receive panel guide or track means for horizontally extending top and bottom panel means 26 and 27 respectively which are vertically movable in the opening 21 into the upper open space 28 provided between top panel means 26 and ceiling 16. In an example of such construction, bathtub wall 20 may be approximately 14 inches in height, each of panel means 26 and 27, 24 inches in height, and a normal ceiling height of 8 feet or 94 inches. The top edge of top panel means 26 when the panel means are in closed position as indicated in FIG. 1 will be approximately 62 inches above the floor surface 11 and slightly above shower head 18. Space 28 may be approximately 32 inches and will readily accommodate panel means 26 and 27 when they are raised into space 28 in open position of the closure means. In fully open position the bottom edge of the bottom panel means 27 is approximately 5 feet 6 inches above floor surface 11 to thereby provide sufficient head room for stepping into the bathtub. It will be understood that the dimensions mentioned above are for purposes of an example and may be varied depending upon the height of the ceiling, the height of the bathtub wall, and the height of panel means of which two or more may be utilized as further described hereafter.

Panel means 26 and 27 are of similar construction; only one panel means will be described in detail, the other panel means being given reference numerals with a prime sign to indicate like parts. Bottom panel means 27 comprises a rigid planar elongated rectangular panel member 30 of suitable transparent, translucent, semi-opaque, or opaque glass, reinforced glass, plastic, or other material which is water resistant and which may provide hard, smooth interior surfaces adapted for facilitating cleaning and maintenance thereof. Exterior surfaces may be smooth or provided with a pattern or design. An exemplary plastic panel (24 inches × 60 inches) may be about ⅛ inch thick and weigh about 3 pounds without the frame members.

Figure 6:
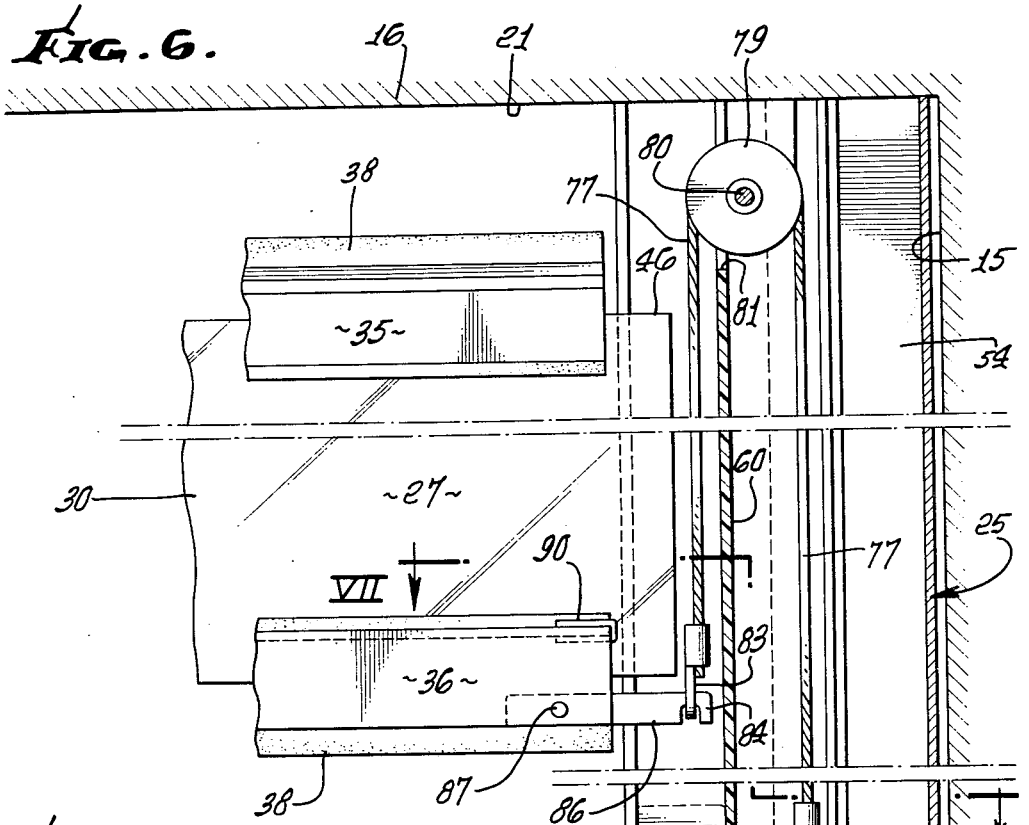
FIG. 6 is an enlarged fragmentary vertical sectional view taken in the planes indicated by line VI—VI of FIG. 4.
Figure 7:
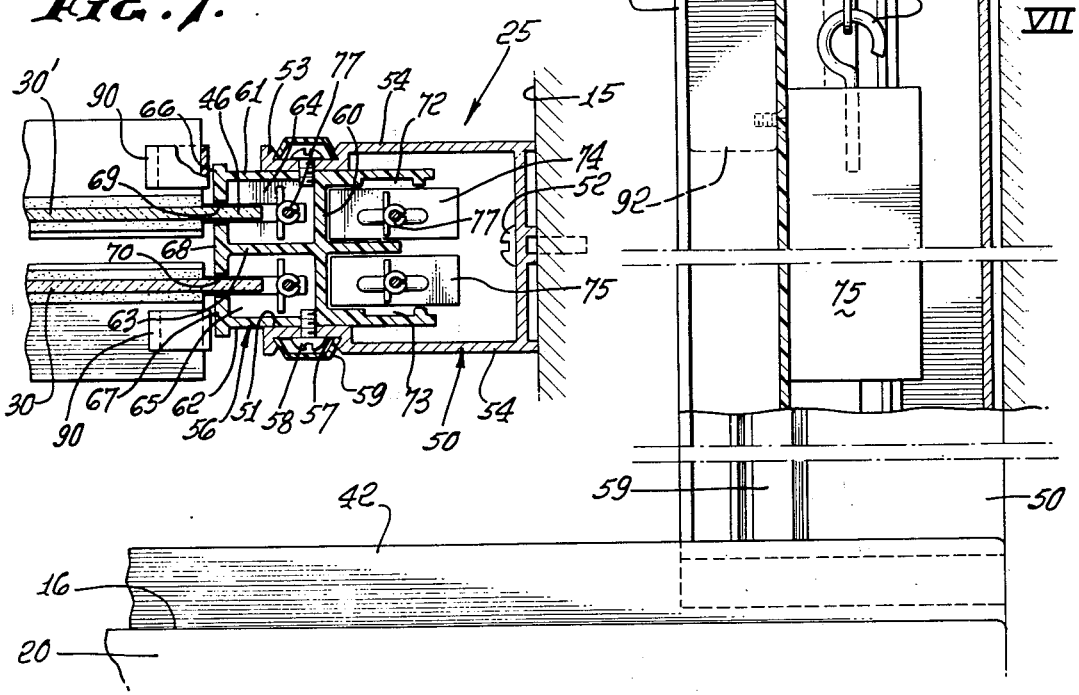
FIG. 7 is a fragmentary reduced sectional view taken in the horizontal planes indicated by line VII—VII of FIG. 6
Figure 8:
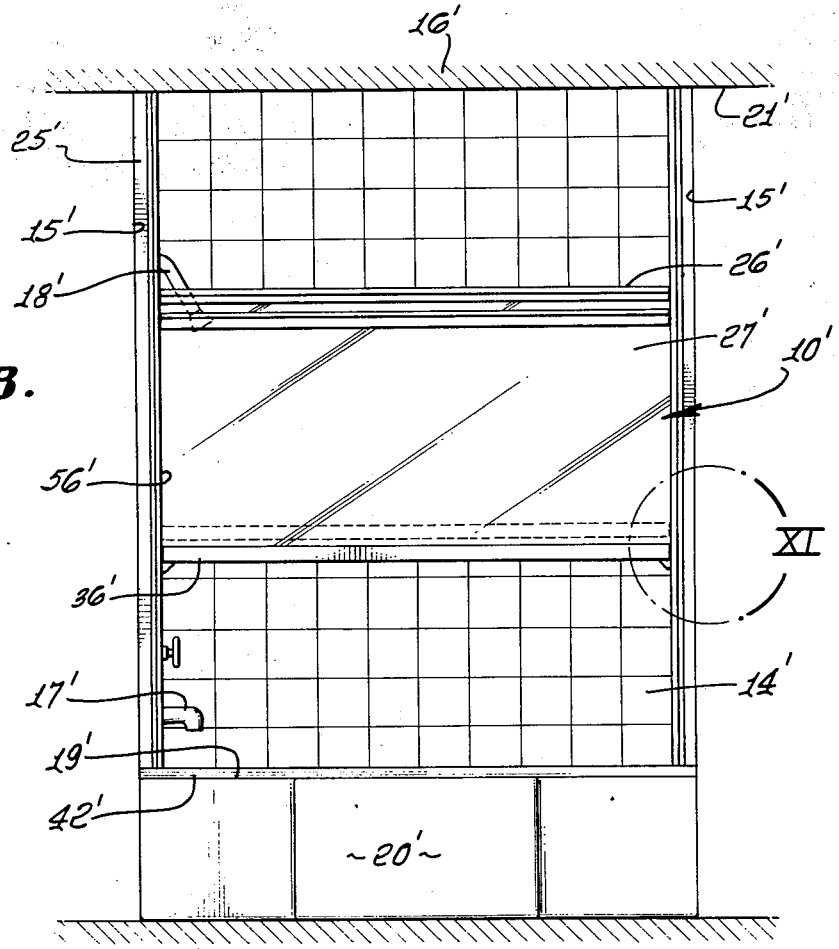
FIG. 8 is a side elevational view of the bathtub closure means embodying this invention illustrating one of the installation steps and construction facilitating such installation.

Each panel member 30, 30' has top and bottom horizontally extending edge portions 31 and 32 receivable within a sealing mold strip 33 carried in a groove 34 formed in top and bottom panel frame members 35 and 36 respectively. Each panel frame member 35, 36 may be of similar cross sectional configuration and includes a longitudinally extending configured recess 37 for snugly retaining a sealing strip 38 provided with a convex sealing surface 39. Bottom sealing strip 38 is adapted to be pressed into sealing engagement at 40 with an inboardly sloping sill surface 41 of a tub sill member 42 secured and sealed to the top surface of tub wall 20. Each frame member 35, 36 may be provided with a downwardly sloping flange strip 44 acting as a water shed or diverter as well as handle-like lift members to facilitate positioning of the panel means 26, 27. Interiorly the flange strips 44 are located on the bottom member 36; exteriorly the strips 44 are located on the upper members 35. As best seen in FIGS. 6 and 7, each panel member 30, 30' has an end portion 46 which extends beyond the end of panel frame members 35, 36 for reception within the panel guide or track means provided in the jamb members 25 as now described.

Each jamb means 25 may be of identical construction and may comprise a vertically disposed U-channel housing member 50 presenting a longitudinal opening 51 lying generally in the plane of the bathtub wall 20 and extending upwardly from said wall 20, in this example, to the ceiling 16. Channel member 50 may be secured to end walls 15 in any suitable manner as by screw bolts 52 and abutment of member 50 with wall 15 may be sealed with well known compositions or sealants to prevent water passing between wall 15 and member 50. Longitudinal opening 51 is defined by oppositely offset longitudinal edge portions 53 of the walls 54 of channel member 50, said offset portions 53 providing smooth opposed surfaces for slidable fitting relationship therebetween of a vertically extending insert track member 56. Offset portions 53 form longitudinal recesses 57 on outer side surfaces of walls 54, said recesses 57 providing space for securement screws 58 for retaining insert member 56 in selected position. An outer longitudinally extending cover 59 of plastic material such as vinyl may cover screw bolts 58 and may serve as a vertical trim strip for channel member 50. Cover 59 may be readily snapped into place along its length.

Insert track or guide member 56 may be made of extruded plastic material such as vinyl and may comprise a central web 60 from which extend in opposite directions spaced inboard and outboard flanges 61, 62 and an intermediate flange 63 defining inner channels 64 and 65 which receive end portions 46 of panel member 30. Each of the inner portions of flanges 61, 62 and 63 may be provided with transverse heads 66, 67 and 68 defining therebetween narrow vertical slots 69 and 70 which slidably receive and guide end portions 46. On the opposite side of central web 60 outer portions of flanges 61, 62, 63 define channels 72 and 73 for slidably guiding counterweight members 74 and 75.

Figure 5:
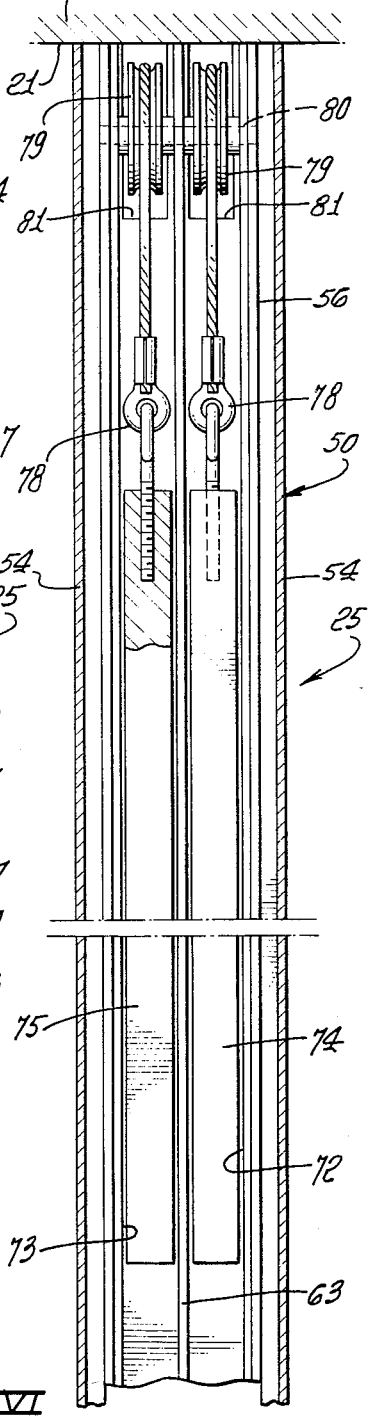
FIG. 5 is a fragmentary vertical enlarged sectional view taken in the plane indicated by line V—V of FIG. 1.

Means for controlling vertical movement of panel means 26 and 27 and for easily selectively, positively positioning said panel means in a desired location in the bathtub opening may comprise the vertically guidable counterweight means 74 and 75 each of which may be suspended from a cable 77 connected by an eye and hook means 78 to the counterweight member 74, 75. Cable 77 passes over an idle pulley 79 rotatable about a pulley shaft 80 supported adjacent the top end of insert member 56 as best seen in FIGS. 5 and 6. Cable 77 at pulley 79 passes through an opening 81 in the center web 60 of the insert member. Cable 77 extends downwardly to the bottom portion of each panel means 26, 27 for connection thereto through an eye 83 and a hook 84 provided on a protruding end portion of a hanger bar 86. Hanger bar 86 may be secured by suitable pin means 87 which extends through walls of the panel frame member 36. It will be understood that hanger bar 86 is provided at opposite ends of each bottom panel frame member 36 for supporting said panel members. Preferably the counterweights 74, 75 substantially balance the weight of the panel members 26, 27 so that said panel members may be readily raised and lowered and stopped at a selected position. Friction in the system normally retains the panels 26, 27 in such selected position.

Each panel frame member 35, 36 at end edges thereof may be provided with clips 90 of suitable anti-friction material such as nylon so that during lateral displacement of panel members 26, 27 during movement, the friction clips 90 will bear against the inner surfaces of flange heads 66 and 67 to facilitate slidable engagement therewith during such movement of the panel means.

Assembly of the panel means 26 and 27 with the jamb means 25 may be readily accomplished after the jamb means 25 is secured to end wall 15. After channel member 50 has been attached to end wall 15, insert member 56 together with the pulley cable and counterweight assembly may be inserted between channel walls 54 and secured in a selected position by the screw bolts 58. Each panel means 26, 27 may be readily connected to the eye 83 on the inner end of cable 77 by inserting the end portion 46 of the panel member together with the hanger bar 86 through the opening 69 to engage the hook 84 with the eye 83. After this is accomplished on one side of the bathtub opening, the panel means may be suitably tilted until the opposite end portion 46 and hanger bar 86 on the panel can be received in the opposite insert member and attached to eye 83.

In closed position as shown in FIGS. 1 and 2 panel members 26 and 27 extend to a height which will normally prevent water from the shower head from being sprayed outside of the bathtub area. The upper panel means 26 extends a sufficient distance below the top edge of the bottom panel member 27 so that water spray will not pass between juxtaposed panel frame members 35 and 36 of the respective panels. Water spraying against the interior surfaces of the panel means will be directed downwardly to the diverter flange strips 44, then to the downwardly sloping sill 41 and thence into the bathtub.

Figure 4:
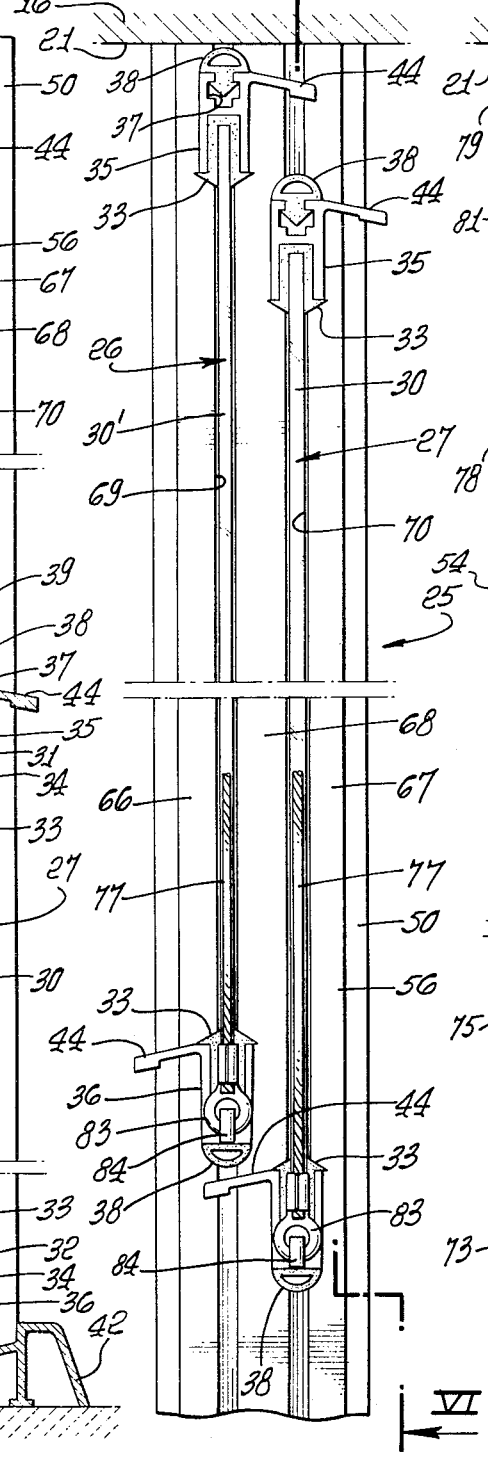
FIG. 4 is a fragmentary vertical sectional view taken in the plane indicated by line IV—IV of FIG. 2.

In open position, as shown in FIGS. 2 and 4 panel means 26 may have its top panel frame member 35 positioned in substantially contacting engagement with the ceiling 16. The bottom panel means 27 may be positioned with its bottom panel frame member 36 located just below the bottom panel frame member 36 of the upper panel means 26, such position being restricted by water diverter strip 44 on the bottom panel means 27.

Stop means for limiting downward displacement of the normally upper panel means 26 from its normally closed position may be provided by attaching a block 92 to the center web 60 in the channel behind slot 69 of each insert member at a predetermined distance above the bathtub wall 14 so that the panel 26 may be positively stopped in closed position. The bottom panel 27 is stopped in lower position by the sill member 42.

It is noted that each guide member 56 is laterally telescopically receivable in the channel housing 50 of the jamb means 25 for permitting adjustment of the horizontal spacing between guide members 56. A close sliding relationship between the panels 26 and 27 and the guide members is thereby provided. Upon such positioning of the panels relative to the guide members 56 and the members 56 relative to the housing 50, the guide members are secured in place with respect to the housings 50 by suitable screws.

A preferred embodiment of this invention is shown in FIGS. 8 – 21 in which modifications of the panel guide or track sections and hanger brackets facilitate operation of the closure means and provide a novel method of assembly and installation which permits one person to install the closure means. For clarity, like parts will be given like reference numerals with a prime sign.

In the bathtub closure means generally indicated at 10', a bathtub 20' is located in a wall recess or alcove having end walls 15' and a ceiling wall 16'. The bathtub closure means 10' comprises panels 26' and 27', jamb means 25' including a composite track means 56', and a sill member 42'. The jamb means 25' including the composite track means 56' are preassembled in a manner described herebelow to facilitate shipping and assembly. It will be understood that since the jamb means and sill are elongated members, they may be shipped in adjacent relation in the same box whereas the panels 26' and 27' may be shipped separately.

Figure 3:
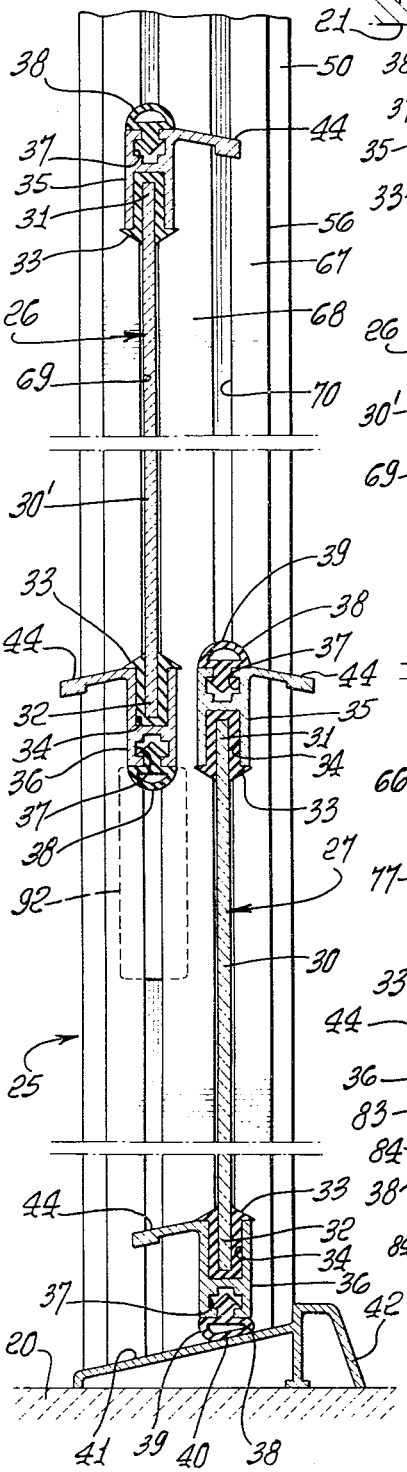
FIG. 3 is a fragmentary vertical sectional view taken in the plane indicated by line III—III of FIG. 1.

Sill member 42' may include a cross-sectional configuration similar to sill 42 of FIG. 3. Sill member 42' is cut to extend the full length of the bathtub and to abut end walls 15'. The sill member is sealed by placing a continuous bead of mastic adhesive along the underside of the center rib and at both ends of the sill member. The slope of the sill is directed toward the inside of the tub.

Each jamb means 25' including composite track means 56' are shipped in assembled relationship with the composite track means received within the track housing 50'. Track means 56' includes a track member of generally H section configuration having side walls 54' joined by a transverse web 60' having an intermediate flange 63' extending parallel to the walls 54' and defining longitudinally extending channels 72', 73' along which counterweights 74', 75' may move. In factory assembly counterweights 74', 75' are secured against movement in shipping by securement screws **74*a* and 75*a* which extend through walls 54' into the counterweights, FIG. 17.**

The walls 54' of the track member slidably engage internal longitudinal offset edge portions 53' of the walls 54'. The walls 54' extend toward the bathtub opening and define with the web 60' a longitudinal opening and channel 51' within which may be received a track or guide section 156 made of extruded plastic material such as vinyl.

Track section 156 may be of general box section including a base web 157, side walls 158 and an intermediate wall 159 said walls terminating in transverse edge portions 160, 161 and 162 which define longitudinal slots 163 and 164 for sliding reception of edge margins of panels 27' and 26' respectively. It will be noted that the track section 156 is snugly fitted within the track member. In factory assembly the channel defined by walls 159 and 158 carries the stop 92' which may be secured therein by suitable screw bolts **92*a* extending through web 60, base wall 157 and into the stop member 92'. The position of the stop member 92' in the track section determines the limit of downward movement of the upper panel 26' as later described, FIG. 11.**

Figure 9:
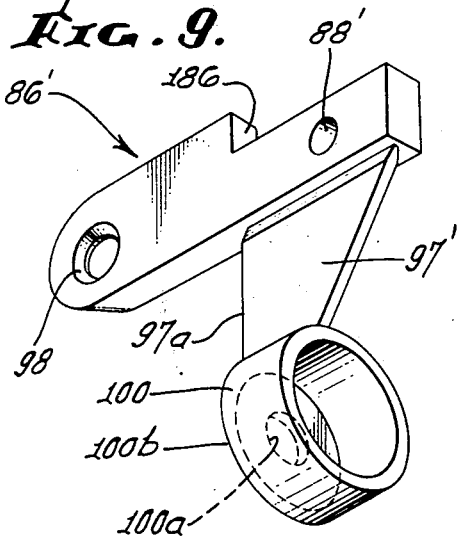
FIG. 9 is an enlarged perspective view of a hanger arm with a break off portion used in installing the upper panel of the closure means.
Figure 10:
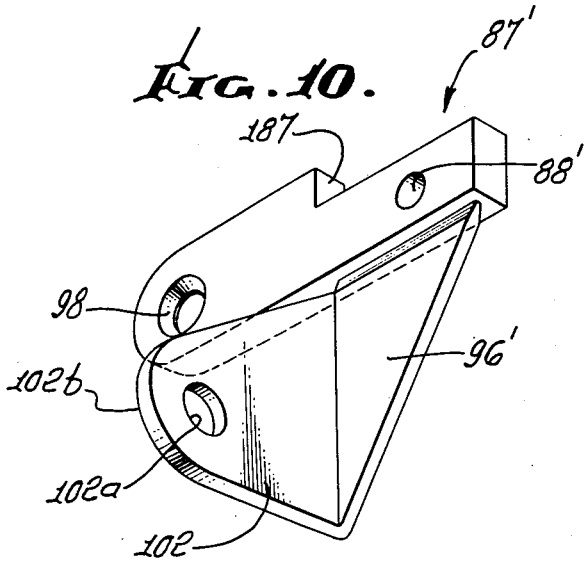
FIG. 10 is an enlarged perspective view of a hanger arm with a break off portion used in installation of the lower panel of the closure means.
Figure 11:
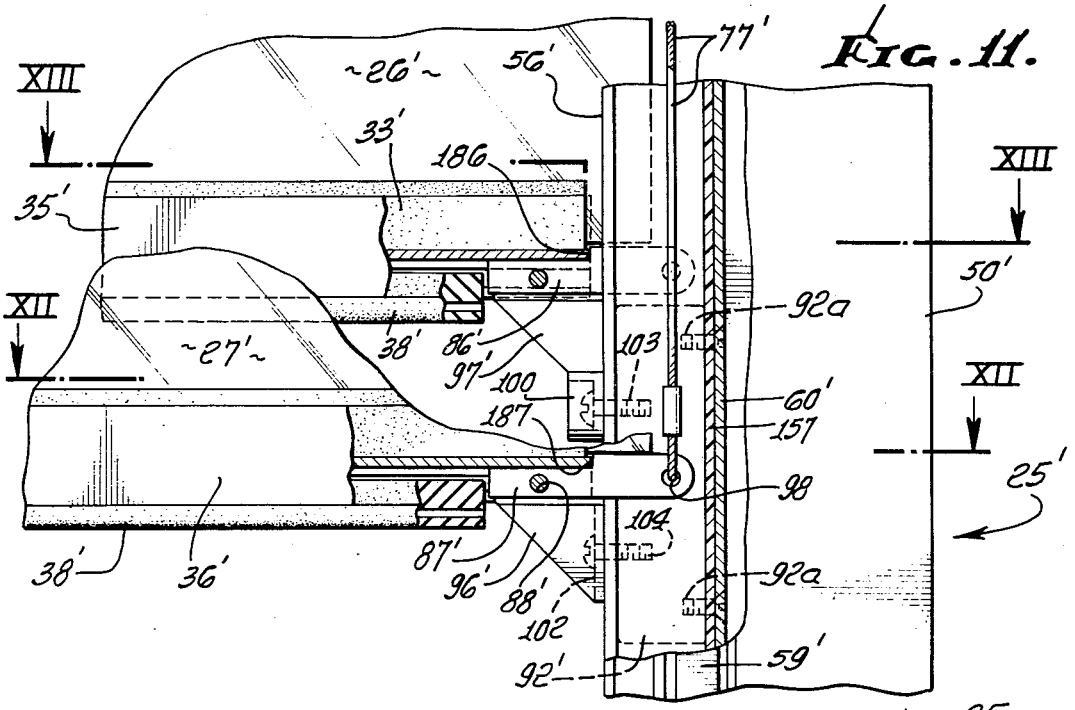
FIG. 11 is an enlarged partially sectional view of the area indicated by the circle identified as XI in FIG. 8.
Figure 12:
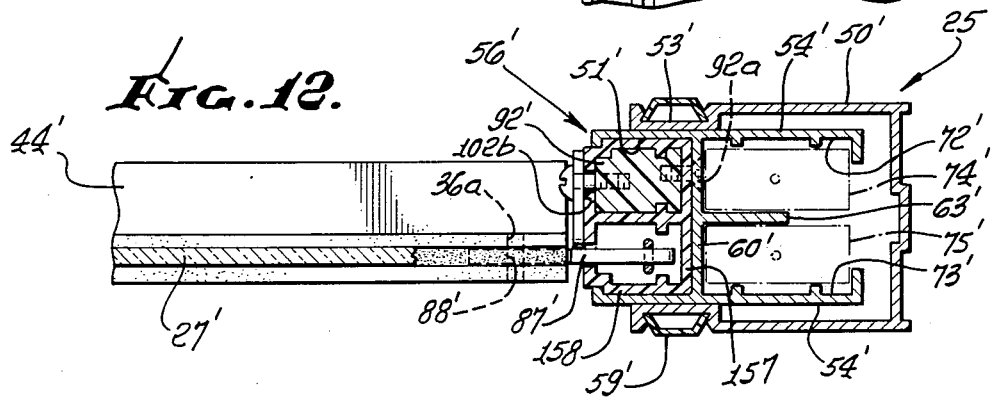
FIG. 12 is a transverse horizontal sectional view taken in the plane indicated by line XII—XII of FIG. 11.
Figure 13:
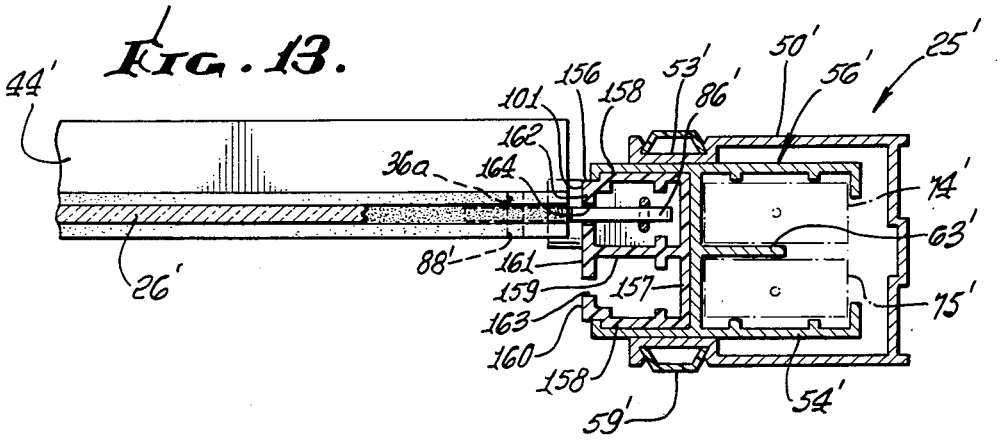
FIG. 13 is a horizontal sectional view taken in the plane indicated by line XIII—XIII of FIG. 11.
Figure 14:
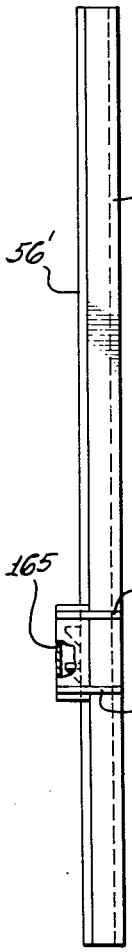
FIG. 14 is a side elevation of a track housing and composite track means in assembled relation for shipping purposes.
Figure 15:
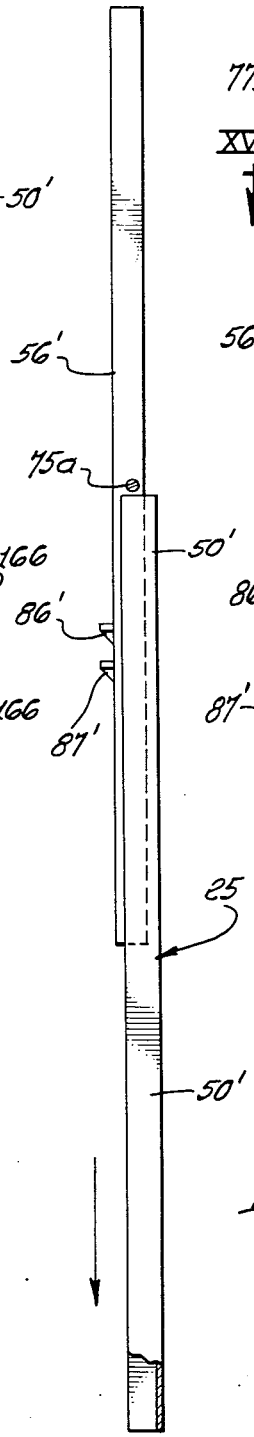
FIG. 15 is an elevational view showing longitudinal withdrawal of the composite track means from the track housing means.
Figure 16:
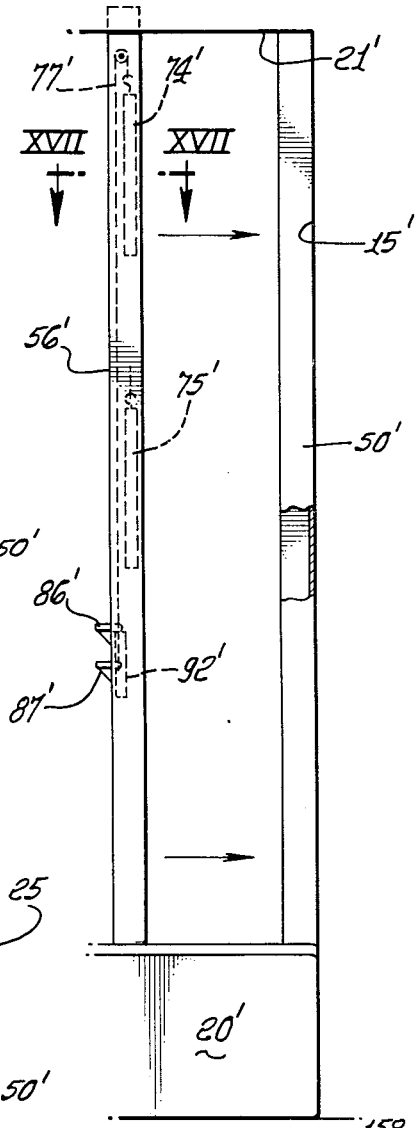
FIG. 16 is a fragmentary view of one side of the bathtub installation illustrating lateral telescoping of the composite track means into the track housing which has been secured to the end wall of the tub alcove.
Figure 18:
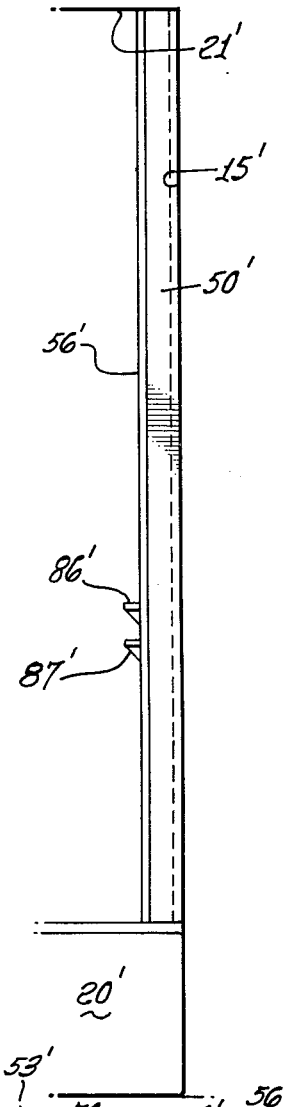
FIG. 18 is a side elevational view of the composite track means in lateral assembly within the track housing at one side of the bathtub opening.
Figure 17:
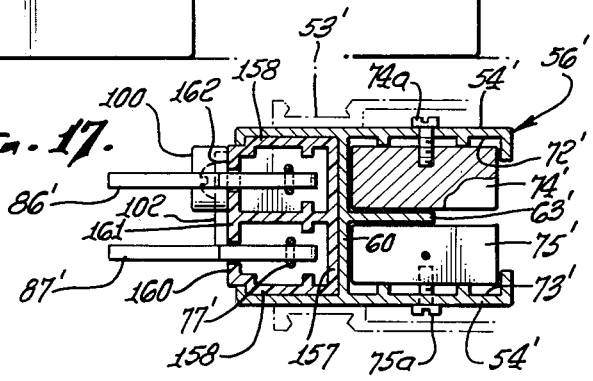
FIG. 17 is a fragmentary enlarged horizontal sectional view taken in the plane indicated by line XVII—XVII of FIG. 16 showing preassembled parts in the composite track section.
Figures 19, 20, 21:
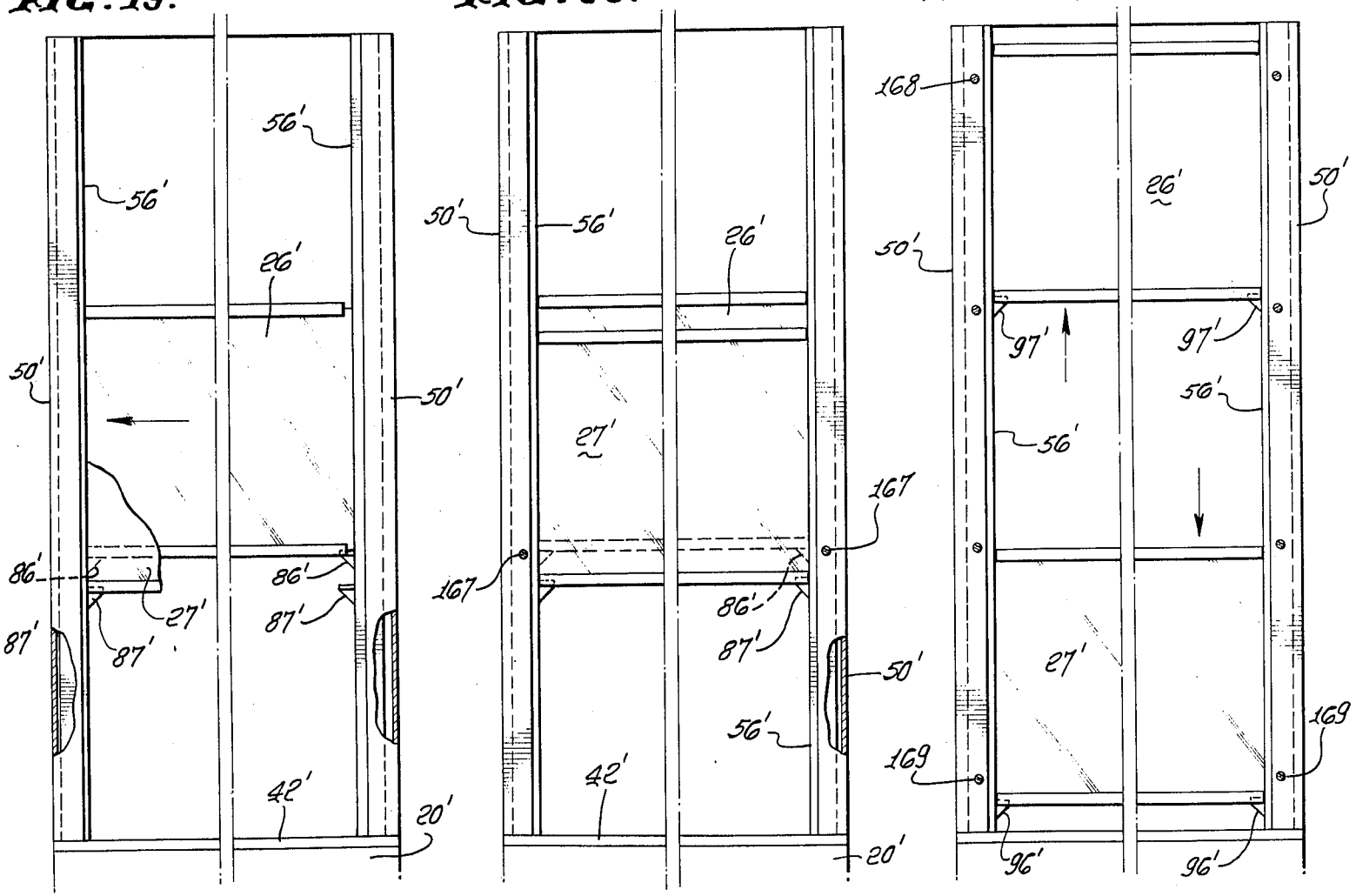
FIG. 19 is a schematic view showing both sides of the bathtub opening provided with assembled track housings and composite track sections and the installation of the panels in said track means.
FIG. 20 is a view similar to FIG. 19 showing both panels in assembly in the bathtub opening and the centering of the composite track sections and securement of the track sections 56' in relation to the track housings 50'.
FIG. 21 is a view similar to FIG. 20 except that the panels have been moved to upper and lower positions to provide alignment of the track sections 56' at the top and bottom of the tub opening and securement thereof to the track housings.

In factory assembly of the track housing 50' and composite track means 56', the panel hanger bars or mounting brackets 86' and 87' are of different configuration than those of the prior embodiment, a hanger bar 86' being for the upper panel 26' and a hanger bar 87' being for the lower panel 27', FIGS. 9, 10. Hanger bar 86' has an arm portion similar to the prior embodiment and provided with an eye 98 for attachment of one end of the cable. At its opposite end, the arm portion has a hole 88' for reception of a bolt for securement to the rail of the panel. The upper edge of the arm has a notch providing a surface 186 for positioning contact with an edge of the bottom rail of the panel. The hanger bar 86' is secured to the bumper member 92' by a depending fin portion 97 carrying a cylindrical section 100 having an end wall with a hole **100*a* therein for reception of a screw bolt. The edge faces 97*a* and 100*b* of the fin and cylindrical portion respectively lie in a plane and are adapted to bear against the guide edge faces of the track section as at 101** as later described.

Since the bumper block 92' is located in the track section along which the upper panel moves, the hanger bar 87' which has an arm portion provided with an eye 98 and a hole 88' and a notch in its upper edge to provide a shoulder surface 187, may be provided with an attachment section of slightly different configuration so that hanger bar 87' may be secured temporarily to the bumper member 92'. As shown in FIG. 10 the attachment section of the hanger bar 87' includes a depending triangular portion 96' lying in the plane of the arm portion and a leg portion 102 which extends at right angles to the triangular portion 96, spans the intermediate flange 159 to locate a hole **102*a* therein for reception of a screw to temporarily attach hanger bar 87' to the bumper bar 92'. The face 102*b* of the portion 102 is adapted to lie against and abut the edge faces of the portions 161 and 162 during assembly. It should be noted that the surfaces 186 and 187 on the hanger bars 86' and 87' are slightly offset from the plane of the edge faces 97*a*, 100*b* on the bar 86' and respectively the face 102*b* of the portion 102 of hanger bar 87' so that a preselected clearance will be provided between the end faces of the panel frame members and the opposed faces of the track section. Thus in preassembly and for shipment, the hanger bars 86' and 87' are attached to the bumper member 92' and are also attached to the end of the cable 77', FIG. 14.**

The projecting hanger bar portions provided with the holes 88' may be protected during shipment by a suitable U shaped rigid plastic cover 165 which may be removably secured by spaced bands of suitable adhesive tape or banding material.

It will thus be apparent that in pre-packaged factory assembled condition, all of the elements required for mounting the panels in a bathtub opening are temporarily secured in selected position and relationship within the track housing and track means. Installation procedure now continues, FIGS. 15–21.

After the sill member has been installed, the track housing 50' and the composite track means 56' are disassembled by removing the tapes 166 and cover 165 and then sliding the composite track means 56' longitudinally out of the track housing 50'. Upon removal of the composite track means the counterweight screws 74a and 75a may be removed to free the counterweights for movement. It will be apparent that the composite track means 56' could not be moved laterally from the housing 50' because of the interference of the heads of the counterweight securement screws 74a and 75a with the offset portions 53' of the track housing.

The track housing 50' is now secured to the end wall 15' by suitable spaced securement bolts and in such a manner that the bottom ends of the track housings which have been provided with a cut end corresponding to the slope of the sill member are snugly fitted against the sill member and sealed at this bottom junction line as well as along the longitudinal length of the jamb housing by suitable sealant and caulking material.

Upon positioning and securing the track housings 50' on their respective end walls 15', each composite track means 56' may be laterally telescopically inserted into the longitudinal openings of the track housings. If necessary the top end of the track housing may be cut to length depending upon the height of the ceiling. The composite track means 56' at this stage in installation are not secured in the track housings.

The upper panel 26' which is provided with top and bottom frame members as in the prior embodiment may then be seated with its bottom rail on the mounting hanger bars 86' on each side of the opening. The panel is moved laterally so that the edge margin of the plastic panel material is inserted into the guide slots 164 and so that the protruding portion of the hanger bracket is received within the opening in the panel frame member. The panel is adjusted laterally or horizontally until the hole 36a in the frame member is aligned with the hole 88' in the hanger bar and a securement pin such as a bolt and nut assembly connects the frame member with the hanger bar. The opposite end of the panel 26' rests upon the hanger bar but is not yet secured.

The bottom panel 27' is similarly horizontally positoned on the hanger bars 87', edge margins of the panel are inserted through the slot 164 and the holes in the protruding arm portion of the bar and the bottom frame member of the bottom panel are secured by a nut and bolt assembly as above.

The opposite ends of the panels 26' and 27' are then secured to the hanger bars at that side of the opening in similar manner. It should be noted that in such securement the location of the holes of the hanger bars for the nut and bolt assemblies is such that the panel is assembled with the edge faces of the track section in desired relatively close tolerance so as to permit non-binding easy slidable operation of the panels. This tolerance is obtained by the relationship of the faces on the breakway securement portions of the hanger bars with respect to the upwardly facing notch on the hanger bars and the location of the hole in the hanger bar and panel frame member.

After the hanger bars have been secured to the panels as above noted, the composite track section means with the panels attached thereto and extending therebetween may be horizontally or laterally adjusted in the opening until they are centered with respect to the vertical edges of the track or jamb housings 50'. When this desired relationship is obtained a securement screw 167 is driven through the offset portion 53' into the wall 54' of the composite track means 56'. The vertical position of this first screw 167 is adjacent the location of the mounting brackets or adjacent the bumper member because the composite track means have been centered at this particular vertical zone. It will be noted that the provision of the securement screw at this point may still permit some pivotal movement of the composite track means so that the top and bottom of the track means may not be precisely horizontally spaced apart.

To accomplish precise horizontal spacing of the composite track means throughout their length in the track housing the mounting bracket securement screws 103, 104 are now removed from their attachment to the bumper member 92' and the upper panel 26' moved to its uppermost position against the ceiling and the bottom panel 27' moved to its lowermost position against the sill. Such spacing of the panels now automatically aligns the composite track means in parallel relationship. Securement screws are then driven through the offset portions 53' adjacent the top of the track housing as at 168 and also adjacent the bottom of the track housing as at 169. The track member 56' is now secured in the track housing and the opposed track means are spaced with desired tolerance to provide for facile sliding movement of the upper and lower panels.

The breakaway sections 96, 97 of the mounting brackets are connected to the arm portions by a thin reduced section of material and may be readily removed as by snapping off. The panels are now operable and readily moved into open and closed position.

Upon removal of the attachment sections 96 and 97, it will be apparent that the panels 26' and 27' may be readily raised and lowered with minimum effort because of the counterweight balancing of the panels and the virtually uniform tolerance between the panel edges and the track sections. In closed relation panel 27' may be lowered with its bottom edge resting upon the sill on the tub wall; panel 26' resting upon the bumper blocks 92' and slightly overlying the upper rail of the bottom panel. Both panels may be raised to uppermost position to facilitate entry into the bathtub.

Operation of the bathtub closure means described above is readily apparent. In closed position as shown in FIG. 1 the panels 26 and 27 provide a water tight sealed closure for the interior of the bathtub to afford privacy and to permit taking a shower without splashing of water outside the bathtub area. In open position as shown in FIG. 2 the panel means are readily moved upwardly into overlying position to provide an opening beneath the panel means which extends through the length of the bathtub and which is of sufficient height so that a person of normal height may readily step into the bathtub. It will also be apparent that the entire length of bathtub wall 14 is unrestricted so that the tub may be readily used for bathing a child. The interior of the tub may be readily cleaned since the entire length of the tub is readily reached by a person kneeling or leaning over the tub wall 14 at any point along its length.

In the examples of the invention described above, two panel means have been shown and described. It will be understood that the invention contemplates the use of two or more horizontally extending vertically movable panels in order to achieve desired closure results. For example, use of three panels of somewhat narrower construction would permit additional head room for entering the tub while providing the same height of the closure. Additional panels may be readily incorporated into the bathtub enclosure design by extruding an insert member having three parallel vertical guide tracks or channels instead of the two channels illustrated.

It will be understood that various modifications and changes may be made in the bathtub closure means described above which come within the spirit of this invention and all such changes and modifications coming within the scope of the appended claims are embraced thereby.

I claim:

1. In a panel guide and track construction for panels movable in frame means in spaced planes into and out of substantial overlapping relation along a track means, the provision of:

a hanger bar means including an elongated portion adapted to be secured to one of said panel members in spaced relation to said track means, and a projecting portion extending into a guide channel in said track means for connection with a counterbalancing system;

and means releasably fastening said hanger bar means to said track means.

2. In a construction as stated in claim 1 wherein said means releasably fastening said hanger bar means to said track means includes a block element positioned in one channel of said track means, and said fastening means includes a fastening element cooperable with said block element.

3. In a construction as stated in claim 1 wherein said means releasably fastening said hanger bar means to said track means includes a block element positioned in one channel of said track means;

a break-off section provided on each hanger bar means associated with each of said panel members, each of said break-off sections being temporarily secured to said block element.

4. In a construction as stated in claim 1 wherein said means releasably fastening said hanger bar means to said track means includes a block element positioned in one channel of said track means, said block element serving as a permanent stop member for one of said panels.

5. In a panel guide and track construction for panels movable in frame means in spaced planes into and out of substantial overlapping relation along a track means, the provision of:

a hanger bar means including an elongated portion adapted to be secured to one of said panel members in spaced relation to said track means, and a projecting portion extending into a guide channel in said track means for connection with a counterbalancing system;

said hanger bar means including a break-off section provided with means for temporarily securing said hanger bar means to said track means in selected position in said guide channels.

6. In a construction as stated in claim 5 wherein said break-off section extends laterally of said elongated portion for temporary securement to means in the adjacent guide channel.

* * * * *